US007900294B2

(12) United States Patent
Luxton et al.

(10) Patent No.: US 7,900,294 B2
(45) Date of Patent: Mar. 8, 2011

(54) SHOWER TRAY ACCESS RAMP

(75) Inventors: Mark Ian Luxton, Onchan (IM); Robert William Stimpson, Douglas (IM)

(73) Assignee: DLP Limited, Douglas (IM)

( * ) Notice: Subject to any disclaimer, the term of this patent is extended or adjusted under 35 U.S.C. 154(b) by 543 days.

(21) Appl. No.: 12/018,835

(22) Filed: Jan. 24, 2008

(65) Prior Publication Data

US 2009/0188035 A1 Jul. 30, 2009

(51) Int. Cl.
*A47K 3/28* (2006.01)
*E01D 1/00* (2006.01)

(52) U.S. Cl. ..... 4/604; 14/69.5

(58) Field of Classification Search ..... None
See application file for complete search history.

(56) References Cited

U.S. PATENT DOCUMENTS 3,555,762 A * 1/1971 Costanzo, Jr ..... 52/588.1
3,859,000 A * 1/1975 Webster ..... 404/41
5,299,330 A 4/1994 Moore et al.
5,341,533 A 8/1994 Seitz
5,446,937 A 9/1995 Haskins et al.
7,694,358 B2 4/2010 Stimpson
2005/0081290 A1* 4/2005 Stimpson ..... 4/613
2009/0189130 A1* 7/2009 Heinz ..... 254/88

FOREIGN PATENT DOCUMENTS

EP 1523914 A1 4/2005
GB 2409673 6/2005
WO WO2004/085762 10/2004

OTHER PUBLICATIONS

European Search Reort for EP09250060 completed Jul. 6, 2009.

* cited by examiner

*Primary Examiner* — Charles Phillips
(74) *Attorney, Agent, or Firm* — Martin Fleit; Paul D. Bianco; Fleit Gibbons Gutman Bongini & Bianco PL

(57) ABSTRACT

A shower tray access ramp comprises a ramp part and a transition part selectively attachable to the ramp part. The ramp part has a first edge for connection to a shower tray, a second edge which is opposite the first edge and which is engagable with the transition part, and a ramp portion intermediate the first and second edges. The second edge includes a flange which is spaced from an upper ramp surface of the ramp portion and which is fastenable to a ramp supporting surface. The transition part has a first transition edge which is seatable on the flange of the ramp part, a second transition edge which is opposite the first transition edge and which tapers to or substantially to a point to provide a transition from the ramp supporting surface onto the access ramp, and a transition ramp portion intermediate the first and second transition edges.

23 Claims, 6 Drawing Sheets

SHOWER TRAY ACCESS RAMP

BACKGROUND OF THE INVENTION

The present invention relates to a shower tray access ramp, a shower tray having such a ramp attached thereto, and a method of installing such a ramp.

Raised shower trays are well known, and are located either directly on the floor of a shower area or are slightly recessed into the floor. In any event, the raised showering surface presented by the tray creates a step for the user to negotiate when transferring into and out of the shower tray.

This step produces problems for the elderly, infirm and disabled, especially wheelchair bound users. Consequently, a ramp up to the shower tray is often employed.

Various national and international standards exist which specify a maximum gradient of such a ramp, and these standards often result in a ramp with a slight or low gradient, thus making the overall length of the ramp large. It is not uncommon to have ramps of 200 mm (8 inches) or more. This in itself creates problems when installing in areas with limited space, since interference with door movement and other, typically ceramic furniture, such as toilets and basin pedestals, can occur.

The present invention seeks to provide solutions to these problems.

SUMMARY OF THE INVENTION

According to a first aspect of the present invention, there is provided a shower tray access ramp comprising a ramp part and a transition part selectively attachable to the ramp part, the ramp part having a first edge connectable to a shower tray, a second edge which is opposite the first edge and which is engagable with the transition part, and a ramp portion intermediate the first and second edges, the second edge including a flange which is spaced from an upper ramp surface of the ramp portion and which is fastenable to a ramp supporting surface; and the transition part having a first transition edge which is seatable on the flange of the ramp part, a second transition edge which is opposite the first transition edge and which tapers to or substantially to a point to provide a transition from the ramp supporting surface onto the access ramp, and a transition ramp portion intermediate the first and second transition edges.

According to a second aspect of the invention, there is provided a raised shower tray having a shower tray access ramp in accordance with the first aspect of the invention attached thereto.

According to a third aspect of the invention, there is provided a method of installing a shower tray access ramp for a raised shower tray, the method comprising the steps of: a) determining whether the shower tray access ramp is to be provided on or to abut against a finishing floor covering material; b) connecting a first edge of a ramp part of the shower tray access ramp to the shower tray via attachment means, and fastening a flange of the second edge which is opposite the first edge to a ramp supporting surface adjacent to the shower tray, a ramp portion of the ramp part extending from the second edge up to the first edge; and c) only if the shower tray access ramp is being provided on a finishing floor covering material, then engaging a first transition edge of a transition part with the flange of the ramp part, whereby a second transition edge opposite the first transition edge tapers to or substantially to a point to provide a smooth transition from the finishing floor covering material onto the access ramp.

According to a fourth aspect of the invention, there is provided a method of installing a shower tray access ramp for a raised shower tray, the method comprising the steps of: a) determining whether the shower tray access ramp is to be provided on or to abut against a finishing floor covering material; b) connecting a ramp part of the shower tray access ramp to the shower tray, and engaging the ramp part to a ramp supporting surface adjacent to the shower tray; and c) only if the shower tray access ramp is being provided on a finishing floor covering material, then engaging a transition part with the ramp part, whereby the transition part provides a substantially smooth transition from the finishing floor covering material onto the access ramp.

The present invention will now be more particularly described, by way of non-limiting example only, with reference to the accompanying drawings.

DESCRIPTION OF THE PREFERRED EMBODIMENTS

Figure 1:
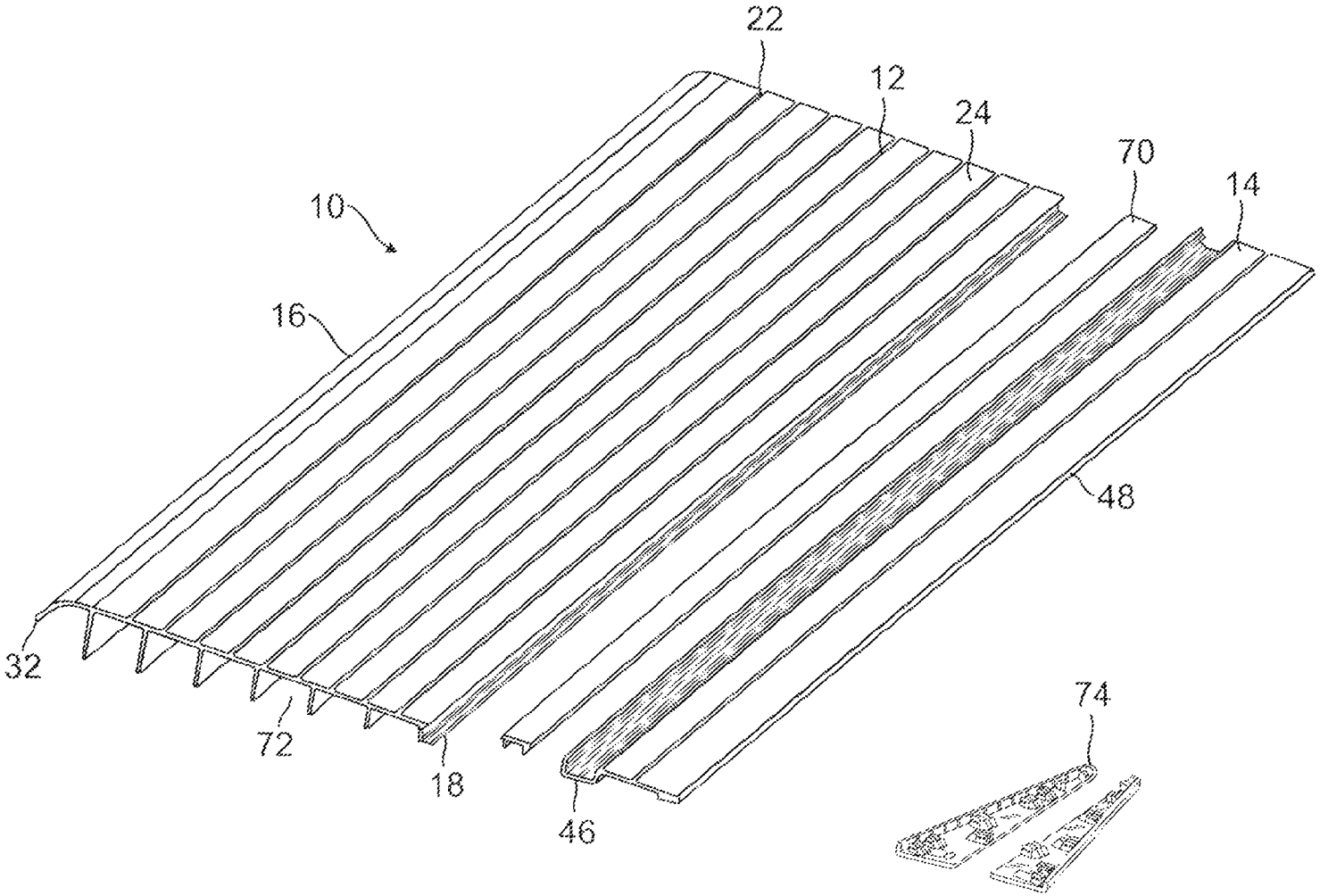
FIG. 1 is a perspective exploded view of one embodiment of a multi-part shower tray access ramp, in accordance with the first aspect of the invention.
Figure 2:
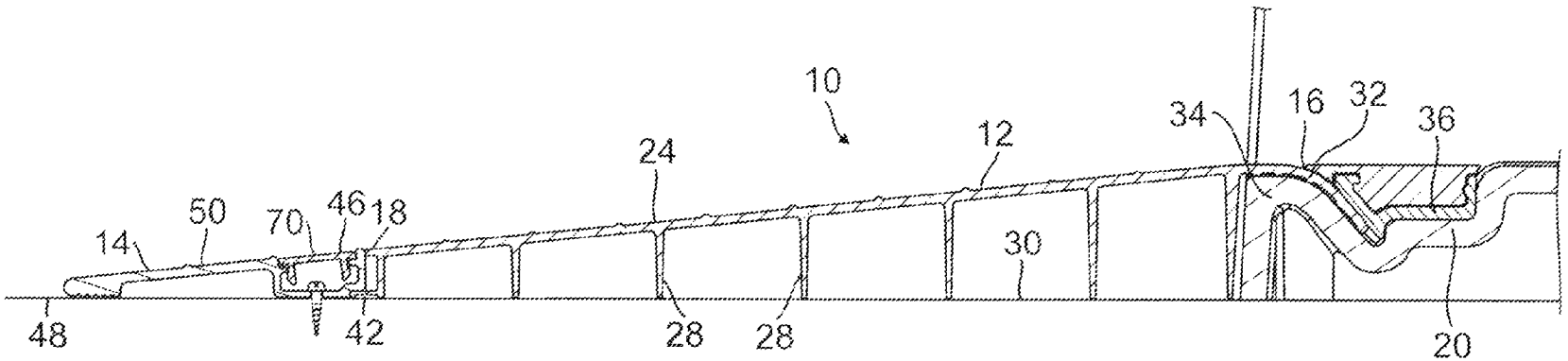
FIG. 2 is a cross-sectional side view of the access ramp once installed on a raised shower tray and directly supported on a finished floor surface.
Figure 3:
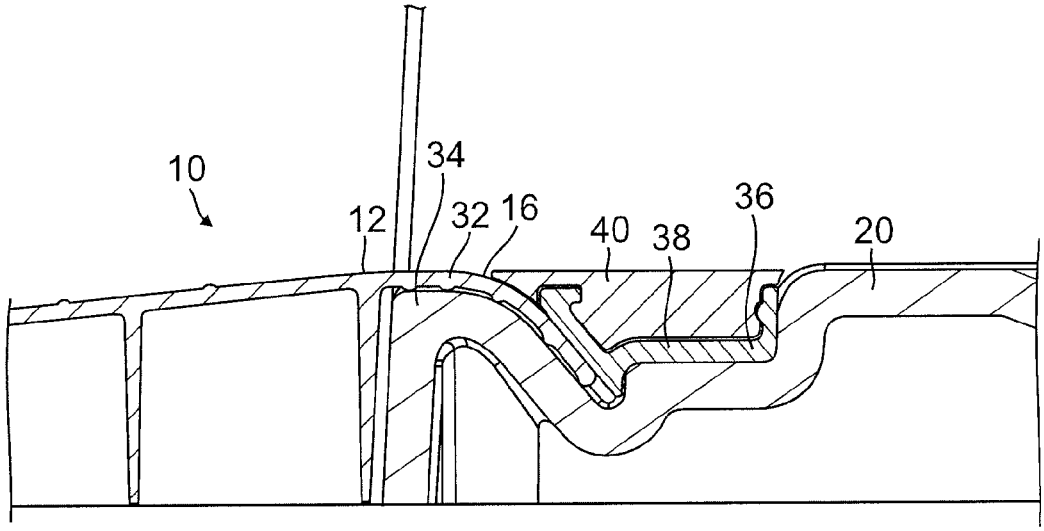
FIG. 3 is an enlarged view of part of the access ramp shown in FIG. 2, showing the attachment to the shower tray.

Referring firstly to FIGS. 1 to 6 of the drawings, there is shown a shower tray access ramp 10, typically formed from extruded plastics, moulded plastics, or extruded and painted metallic materials, and which comprises a main ramp part 12 and a secondary transition part 14 which is selectively attachable to the main ramp part 12.

The main ramp part 12 includes first and second edges 16, 18 which are opposite and, preferably, parallel to each other. However, the second edge 18 may be shaped to fit around floor standing ceramic furniture. The first edge 16 is connectable to a shower tray 20, and the second edge 18 is engagable with the transition part 14. A ramp portion 22 having an upper ramp surface 24 of suitable gradient to meet national and international standards extends between the first and second edges 16, 18. Elongate ridges 26 are provided thereon to aid grip for a user. Reinforcing ribs 28 extend along the longitudinal extent of the ramp part 12 below the upper ramp surface 24 to support the ramp part 12 on the ramp supporting surface 30 or floor.

To enable connection with the shower tray 20, the first edge 16 of the ramp part 12 includes a protruding lip 32 which extends along the longitudinal extent of the ramp part 12. In this case, the lip 32 depends in a curved manner and may be slightly flexible. The lip 32 is complementarily shaped to match a perimeter edge 34 of the shower tray 20 having a recess 36, which may be a trough, channel, slot or shoulder, therein. A clamping bar 38 and capping strip 40 are also provided. The clamping bar 38 clamps the lip 32 of the ramp part 12 into the edge recess 36. The clamping bar 38 is preferably fastened directly to a surface of the edge recess 36 without perforation of the lip 32 or providing a leak path through the shower tray 20. Fastening can occur either with screw-threaded fasteners (not shown) and/or adhesive. The capping strip 40 is then applied, typically as a push- or snap-fit, in order to cover the edge recess 36 and to provide a substantially flush finish.

Figure 4:
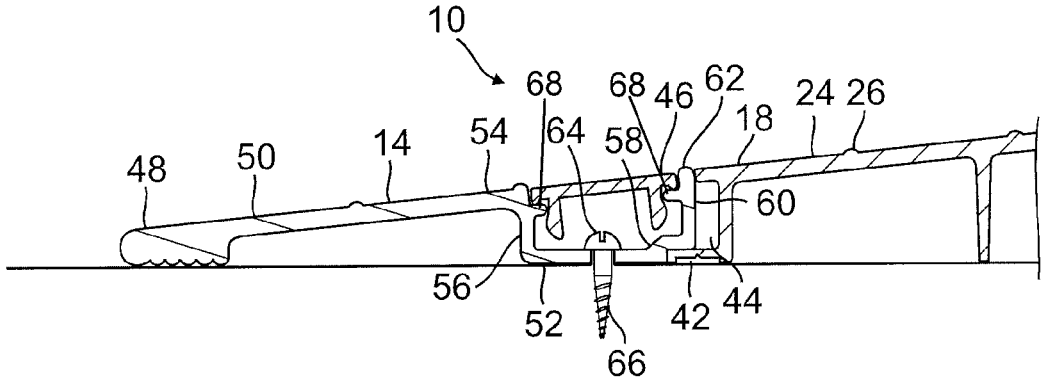
FIG. 4 is an enlarged view of another part of the access ramp shown in FIG. 2, showing a transition part of the ramp attached to a main ramp part.

To enable connection with the secondary transition part 14, the second edge 18 of the main ramp part 12 includes a flange 42 which, preferably, extends along the longitudinal extent of the ramp part 12. As best seen in FIG. 4, the flange 42 extends laterally from a lowermost edge of the reinforcing rib 28 closest to the end of the upper ramp surface 24. The flange 42 is thus spaced from the upper ramp surface 24, and the upper ramp surface 24 projects and overlaps the flange 42.

An elongate recess 44 or channel which extends the longitudinal extent of the ramp part 12 is thus defined in the second edge 18 by the reinforcing rib 28, the flange 42 and the projecting upper ramp surface 24.

The transition part 14 includes a first transition edge 46, a second transition edge 48 which is opposite and, preferably, parallel to the first transition edge 46, and a transition ramp portion 50 which extends between the first and second transition edges 46, 48.

The first transition edge 46 includes a transition flange 52 which is spaced from an upper transition ramp surface 54 of the transition ramp portion 50. The transition flange 52 is formed at the free distal end of a further reinforcing rib 56 so as to project away from the second transition edge 48. The transition flange 52 includes a step 58 partway between its two longitudinal edges, and an upstanding wall 60 provided at its free distal end. The transition flange 52 thus lies directly on the ramp supporting surface 30 or floor, seats on the flange 42 of the ramp part 12 by the provision of the step 58, and the upstanding wall 60 abuts an edge of the upper ramp surface 24 of the ramp part 12. In this condition, the upstanding wall 60 projects above or beyond the upper ramp surface 24 so as to provide a further ridge 62 for gripping.

A further elongate recess 64 or channel which extends the longitudinal extent of the transition part 14 is thus defined at the first transition edge 46 of the transition part 14 by the reinforcing rib 56, the transition flange 52 and the upstanding wall 60. Due to the transition flange 52 being supported directly by the floor surface 30 therebeneath, fastening can occur either with one or more screw-threaded fasteners 66 and/or adhesive. Furthermore, this fastening consequently results in clamping engagement of the flange 42 of the ramp part 12 between the floor surface 30 and the underside of the overlapping transition flange 52. As such, separate fastening of the flange 42 of the ramp part 12 can be dispensed with, if necessary.

This further recess 64 includes two inwardly projecting shoulders which extend in parallel with each other at or adjacent to an upper opening of the recess 36. The shoulders 68 are adapted to support and engage a push- or snap-fit capping strip 70 which covers the recess 64. The capping strip 70 is coplanar with the upper transition ramp surface 54.

The second transition edge 48 tapers to or substantially to a point to provide an easy and largely smooth transition from the ramp supporting surface 30 or floor onto the access ramp 10.

Exposed side ends 72 of the ramp part 12 and transition part 14 are closed by, preferably trimable, end caps 74, shown in FIG. 1. The end caps 74 can be fastened to the ramp part 12 and transition part 14 by any suitable means, and for example, can be snap- or push-fit, or bonded.

Although the ramp part 12 and transition part 14 have typically rectilinear longitudinal extents, there will be cases when the access ramp 10 must extend around a corner of the shower tray 20 so that the access ramp 10 can project from two or more sides of the shower tray 20.

Figure 5:
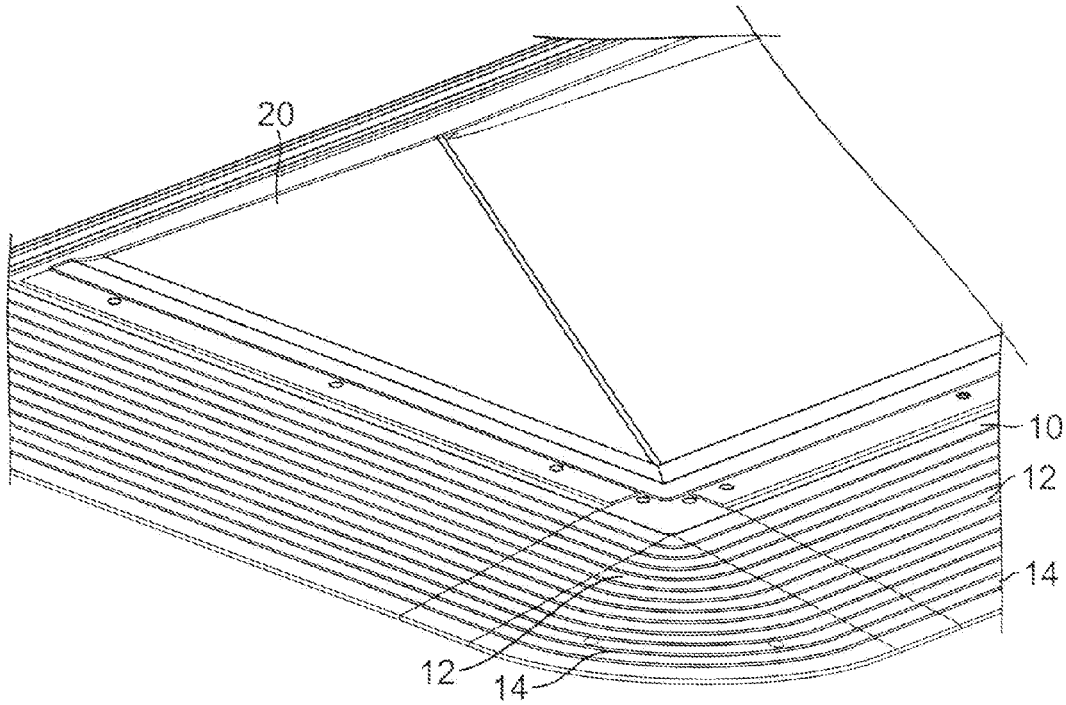
FIG. 5 is a perspective view of the access ramp installed on two sides of the shower tray and around one corner.
Figure 6:
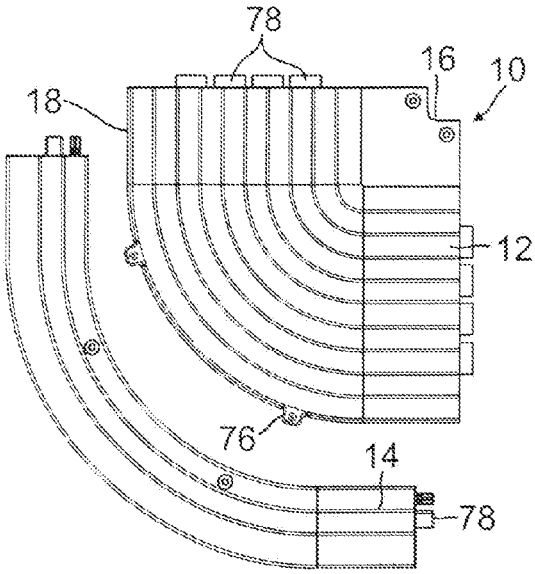
FIG. 6 is a plan view showing the access ramp adapted to extend around a corner of the shower tray.

In this case, as best seen in FIGS. 5 and 6 the first and second edges 16, 18 of the ramp part 12 and the first and second transition edges 46, 48 of the transition part 14 are smoothly curved, instead of straight as described above.

The continuous flange 42 of the ramp part 12 is replaced with a plurality of spaced flanges, for example, tabs 76. These tabs 76 can be independently fastened to the ramp supporting surface 30 using, for example, screw-threaded fasteners or adhesive.

The transition flange 52 on the transition part 14 is also dispensed with.

A plurality of spaced end connectors 78 are provided in castellated fashion along each side end 72 of the corner ramp part 12 and the corner transition part 14. The end connectors 78 are sufficiently spaced to receive as a close or tight fit the reinforcing ribs 28 and 56 of respective adjacent ramp and transition parts 12, 14.

The transition part 14 described in the above case is typically only utilised when the ramp supporting surface 30 is a finished floor. The term 'finished' means that a final floor covering material has been laid, and by way of example, this can be a flexible plastics impermeable waterproof floor covering, such as Altro®, or an inflexible or rigid floor covering, such as tiles or wood.

However, by raising the height of the finished floor surface relative to the installed shower tray 20, the transition part 14 can be dispensed with, thus effectively reducing the ramp distance without altering the gradient. It will thus be understood that the above-described transition part 14 has a typical maximum height equivalent to the depth of a finishing surface or layer.

Figure 7:
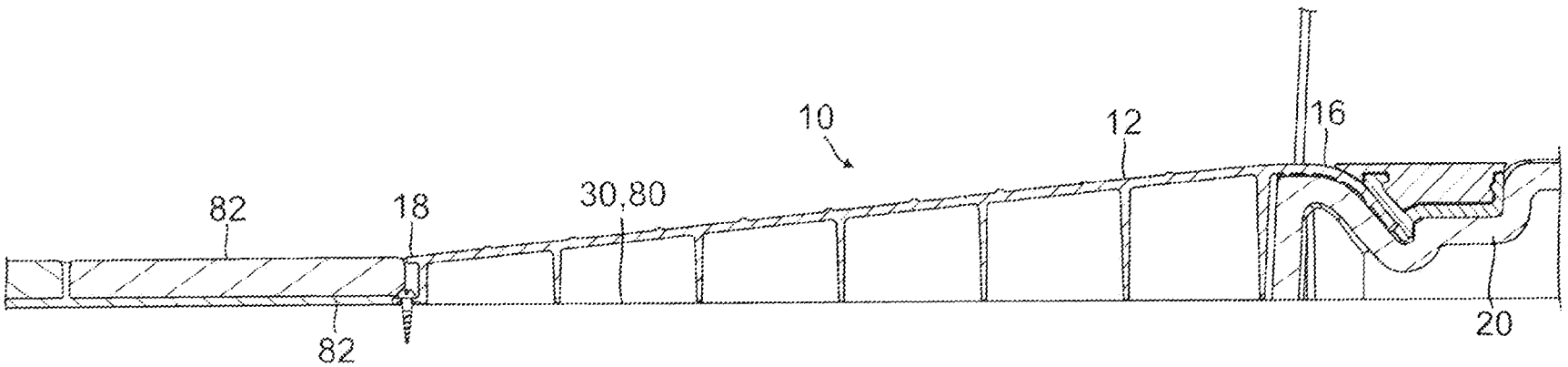
FIG. 7 is a cross-sectional side view of the access ramp once installed on a raised shower tray and directly supported on an unfinished floor surface, a finishing surface being shown applied thereafter.
Figure 8:
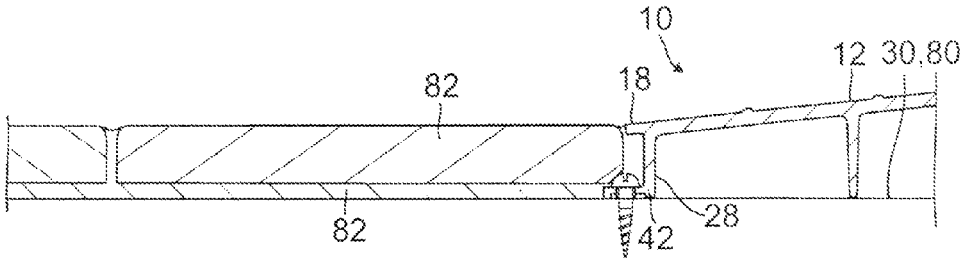
FIG. 8 is an enlarged view of part of the access ramp shown in FIG. 7, showing a the main ramp part with the finishing surface abutting.
Figure 9:
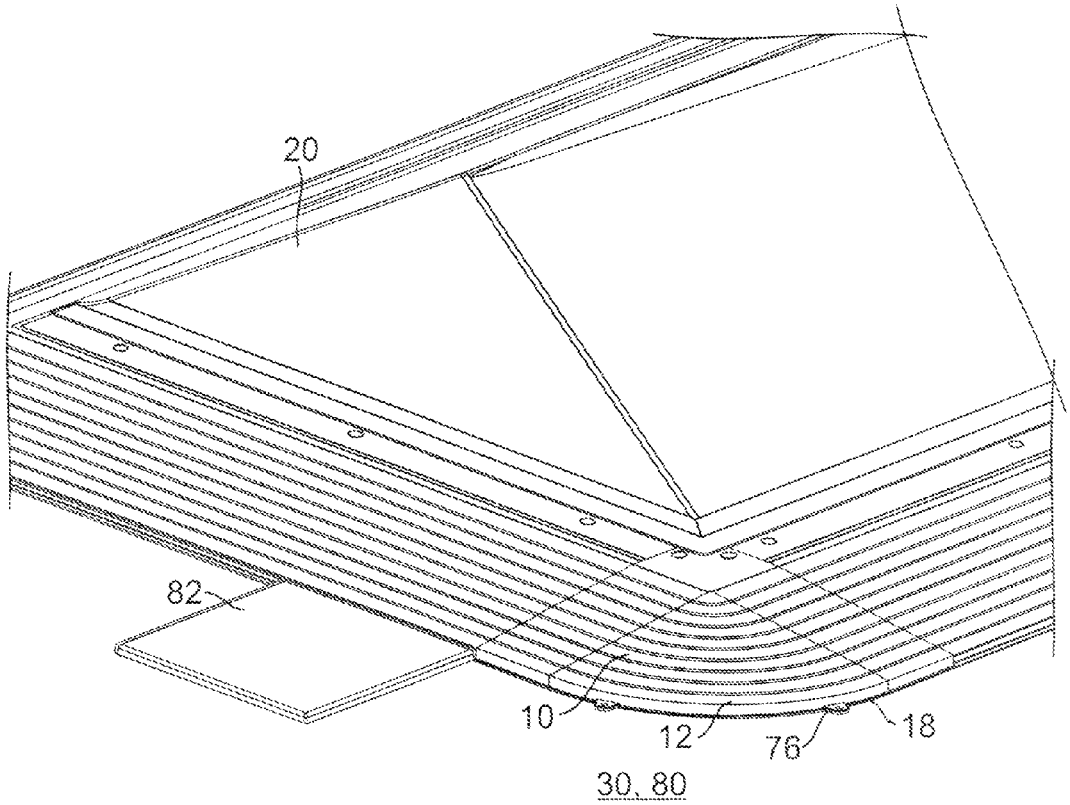
FIG. 9 is a perspective view of the access ramp installed on two sides of the shower tray and around one corner, showing part of the finishing surface abutting the main ramp part.

With reference to FIGS. 7 to 9, a decision is therefore made that the main ramp part 12 is to be provided on an unfinished floor 80 and thus the transition part 14 is to be dispensed with. The main ramp part 12 is as described above, and therefore like references are used and further detailed description is omitted.

The first edge 16 of the main ramp part 12 is attached to the edge recess 36 of the shower tray 20, as described above. However, the flange 42 of the second edge 18 is preferably directly fixed to the ramp supporting surface 30/80 via one or more fasteners and/or adhesive.

Straight and curved sections of the main ramp part 12 are installed, as necessity dictates, along one or more sides of the shower tray 20.

Once installed, a finishing surface 82 or layer, in this case tiles, is installed on the unfinished ramp supporting surface 30/80. The finishing surface 82 overlaps the flange 42 of second edge 18 of the ramp part 12 and abuts or substantially abuts the upper ramp surface 24. As such, a flush or smooth transition from the finished surface 82 to the access ramp 10 is provided.

Consequently, it is understood that the spacing between the flange 42 of the ramp part 12 and the upper ramp surface 24 is equal or substantially equal to a depth of the finishing surface 82.

The finishing surface can extend fully into the recess or channel defined in the second edge of the ramp part, or the finishing surface can extend up to the edge of the upper ramp surface, thus overlapping the flange but extending into the recess.

It is entirely feasible that the direct fastening of the flange of the ramp part to the unfinished ramp supporting surface is dispensed with, in favour of sole reliance on the overlapping of the finishing surface to hold the flange in place.

Although the recesses in the second edge of the ramp part and the first edge of the transition part can be channels, they can take other forms, such as short openings. For example, instead of a single continuous flange, a plurality of spaced flanges, such as tabs, can be utilised. In this case, the capping strip for the further recess of the transition part has a complementary dimension.

Other means for connecting the first edge of the ramp part to the shower tray can be employed, instead of clamping. For example, bonding or screwing.

Although it is preferable that the access ramp is attached in overlapping fashion to an upper surface of the shower tray, in order to reduce possible leak paths therebetween, it is feasible that the first edge of the ramp part can be attached or connected, either directly or indirectly, for example via the use of sealant or adhesive, to a side of the shower tray.

Although a clamp device is suggested above, other attachment means for attaching the first edge of the ramp part to the upper surface of the shower tray can be utilised, such as bonding or screw-threaded fasteners.

It is also feasible that the lip could extend across and round a raised edge of the shower tray and attached to an inner surface of the shower tray.

It is thus possible to provide a shower tray access ramp which is multi-part or modular in nature, and which in certain installations can provide a reduced protruding extent from the shower tray without altering a ramp gradient. It is also possible to provide a dual use shower tray access ramp which permits installation onto both finished and unfinished floor surfaces whilst maintaining a smooth transition from the finishing surface onto the access ramp.

The embodiments described above are given by way of examples only, and various other modifications will be apparent to persons skilled in the art without departing from the scope of the invention, as defined by the appended claims.

What is claimed is:

1. A shower tray access ramp for providing transition from a supporting surface to an elevated shower comprising a ramp part and a transition part selectively attachable to the ramp part, the ramp part having a first edge connectable to a shower tray, a second edge which is opposite the first edge and which is engagable with the transition part, and a ramp portion intermediate the first and second edges, the second edge including a flange which is spaced from an upper ramp surface of the ramp portion and which is fastenable to a ramp supporting surface; and the transition part having a transition flange that is at least in part seatable on and attachable to the supporting surface and at least in part seatable on the flange of the ramp part, a second transition edge which is opposite the first transition edge and which tapers to or substantially to a point to provide a transition from the ramp supporting surface onto the access ramp, and a transition ramp portion intermediate the first and second transition edges.

2. A shower tray access ramp as claimed in claim 1, wherein the upper ramp surface overlaps the flange.

3. A shower tray access ramp as claimed in claim 1, wherein the flange projects beyond the upper ramp surface of the ramp portion.

4. A shower tray access ramp as claimed in claim 1, wherein the second edge includes a recess defined in part by the upper ramp surface and the flange.

5. A shower tray access ramp as claimed in claim 4, wherein the recess is an elongate channel which extends along the ramp part.

6. A shower tray access ramp as claimed in claim 1, wherein the first transition edge of the transition part includes a second flange which is fastenable to the ramp supporting surface, the in use second flange engaging the first said flange of the ramp part to hold the said first flange to the ramp supporting surface.

7. A shower tray access ramp as claimed in claim 6, wherein the first transition edge further includes an upstanding wall which is abuttable against an edge of the upper ramp surface of the ramp part.

8. A shower tray access ramp as claimed in claim 7, wherein the upstanding wall projects beyond the upper ramp surface so as to provide a ridge.

9. A shower tray access ramp as claimed in claim 7, wherein the said second flange and upstanding wall in part form a second recess for receiving at least one floor fastener.

10. A shower tray access ramp as claimed in claim 9, wherein the said second recess is a second elongate channel which extends along the transition part.

11. A shower tray access ramp as claimed in claim 8, wherein the transition part includes a cap which in use closes the second recess.

12. A shower tray access ramp as claimed in claim 1, wherein the first edge of the ramp part includes a lip for location in a recess of the shower tray.

13. A shower tray access ramp as claimed in claim 1, further comprising attachment means for attaching the first edge of the ramp part to the shower tray.

14. A shower tray access ramp as claimed in claim 1, wherein the ramp part and the transition part have rectilinear longitudinal extents.

15. A shower tray access ramp as claimed in claim 1, wherein the or further ramp and transition parts include one or more curved edges so as the be extendable around a corner of the shower tray.

16. A raised shower tray having a shower tray access ramp as claimed in claim 1 attached thereto.

17. A raised shower tray as claimed in claim 16, wherein the shower tray access ramp is attached to an upper surface of the shower tray.

18. A raised shower tray as claimed in claim 16, wherein the shower tray access ramp is clamped to an upper surface of the shower tray.

19. A method of installing a shower tray access ramp for a raised shower tray, the method comprising the steps of:

a) providing the shower tray access ramp of claim 1;

b) determining whether the shower tray access ramp is to be provided on or to abut against a finishing floor covering material;

c) connecting the first edge of the ramp part of the shower tray access ramp to the shower tray via attachment means, and fastening the flange of the second edge which is opposite the first edge to the ramp supporting surface adjacent to the shower tray, the ramp portion of the ramp part extending from the second edge up to the first edge; and d) only if the shower tray access ramp is being provided on a finishing floor covering material, then engaging the first transition edge of the transition part with the flange of the ramp part, whereby the second transition edge opposite the first transition edge tapers to or substantially to a point to provide a smooth transition from the finishing floor covering material onto the access ramp.

20. A method as claimed in claim 19, wherein, in step c), the first edge of the ramp part is attached to an upper surface of the shower tray.

21. A method as claimed in claim 19, wherein, in step d), if the shower tray access ramp is to abut the finishing floor covering material, then the transition part is dispensed with and the finishing floor covering material is provided up to the second edge of the ramp part so as to overlap and engage the flange.

22. A method as claimed in claim 19, wherein the finishing floor covering material is one of tiles, wood, and flexible plastics waterproof flooring covering material.

23. A method of installing a shower tray access ramp for a raised shower tray, the method comprising the steps of:

a) providing the shower tray access ramp of claim 1;

b) determining whether the shower tray access ramp is to be provided on or to abut against a finishing floor covering material;

c) connecting the ramp part of the shower tray access ramp to the shower tray, and engaging the ramp part to the ramp supporting surface adjacent to the shower tray; and d) only if the shower tray access ramp is being provided on a finishing floor covering material, then engaging the transition part with the ramp part, whereby the transition part provides a substantially smooth transition from the finishing floor covering material onto the access ramp.

* * * * *